US005950457A

United States Patent [19]

Wagner, Jr. et al.

[11] Patent Number: 5,950,457

[45] Date of Patent: Sep. 14, 1999

[54] WARP KNIT, WEFT INSERTED BACKLIT SIGN SUBSTRATE FABRIC

[75] Inventors: Carl P. Wagner, Jr., Cheraw, S.C.; Jack S. Rogers, Greensboro, N.C.

[73] Assignee: Highland Industries, Inc., Greensboro, N.C.

[21] Appl. No.: 08/864,195

[22] Filed: May 28, 1997

[51] Int. Cl.[6] ..... D04B 23/12

[52] U.S. Cl. ..... 66/192; 66/195; 442/314

[58] Field of Search ..... 66/192, 190, 193, 66/195; 442/308, 314

[56] References Cited

U.S. PATENT DOCUMENTS

| | | | |
|---|---|---|---|
| 2,062,999 | 12/1936 | Plumb | 66/192 X |
| 2,263,787 | 11/1941 | Safferson | 66/192 X |
| 3,251,201 | 5/1966 | Newman | 66/192 |
| 3,672,187 | 6/1972 | Simpson | 66/192 |
| 3,949,570 | 4/1976 | Niederer | 66/10 |
| 4,285,216 | 8/1981 | Duhl | 66/192 |
| 4,443,516 | 4/1984 | Rogers | 428/253 |
| 4,624,116 | 11/1986 | Rogers | 66/193 |
| 4,841,749 | 6/1989 | Petracek et al. | 66/195 |
| 4,918,793 | 4/1990 | Spindler | 66/192 X |
| 5,067,331 | 11/1991 | Porter | 66/195 |
| 5,191,777 | 3/1993 | Schnegg | 66/195 |
| 5,317,886 | 6/1994 | Prahl | 66/192 |

OTHER PUBLICATIONS

Portion of book entitled "Warp Knit Fabric Construction", U. Wilkens Verlag, Heusenstamm, Germany, 1995, pp. 123–130.

*Primary Examiner*—John J. Clavert
*Assistant Examiner*—Larry D. Worrell, Jr.
*Attorney, Agent, or Firm*—Rhodes, Coats & Bennett, L.L.P.

[57] ABSTRACT

A warp knit, weft inserted fabric substrate for use as a strength component in vinyl coated and laminated backlit signs, awnings and in other applications where stability and uniform geometry is desired. The stable knit construction of the fabric is achieved by doubling the number of stitches or courses per inch of fabric. To avoid changing the industry-wide standard fabric construction of 18x12 with the stitch doubling, weft yarns are inserted every other stitch. In a fabric having an 18 x 12 construction, the number of stitches doubles from 12 to 24. The final fabric construction is 18 warp ends per inch, 12 weft ends per inch, and 24 courses per inch. Although the course count increases from 12 to 24 stitches per inch, only one weft yarn is inserted for every two stitches rather than every stitch as currently done in the prior art. By doubling the number of stitches through shortening the stitch length, the weft or filling yarns area forced to remain in a restricted are of the fabric. As a result, the final fabric exhibits enhanced stability and exceptional visual geometry. The fabric is preferably constructed with only one knitting bar which operates with a movement of 1-0/1-2 and a lay in bar with a movement of 1—1/0—0.

18 Claims, 3 Drawing Sheets

L1 1-0/1-2
ST 1-1/0-0

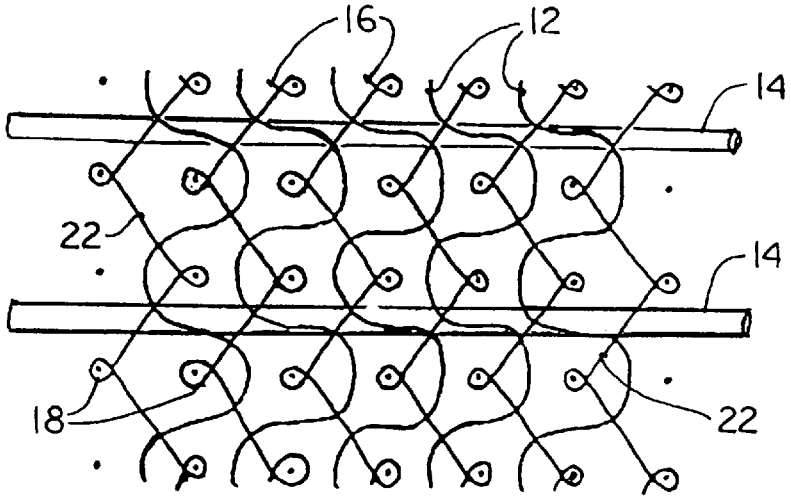
$L_1$ 1-0/1-2
ST 1-1/0-0
FIG. 5
FIG. 6
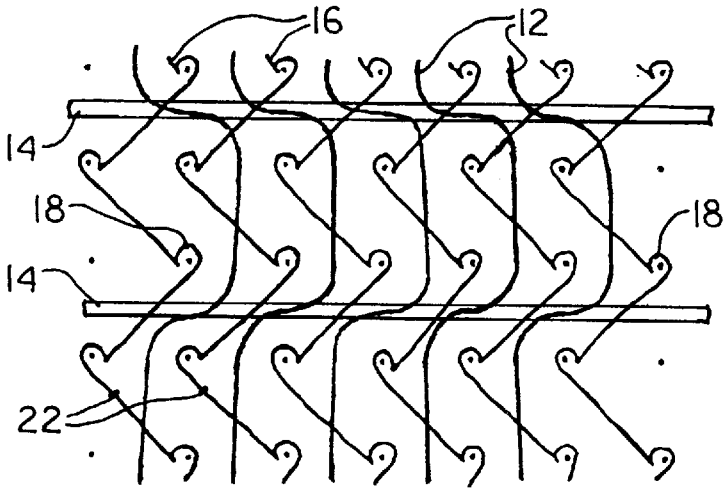
$L_1$ 0-1/2-1
ST 1-1/1-1/0-0/0-0

WARP KNIT, WEFT INSERTED BACKLIT SIGN SUBSTRATE FABRIC

FIELD OF THE INVENTION

The present invention is directed to an improved warp knit, weft inserted fabric substrate that is used as the strength component in backlit signs, awnings and in other applications where uniform fabric geometry, strength and stability are desired. More particularly, the present invention is directed to a warp knit, weft inserted fabric in which the stitch length is modified without changing the number of weft yarns per inch of fabric.

BACKGROUND OF THE INVENTION

Fabrics that are used as the strength member in vinyl coated and laminated backlit sign applications are in wide use throughout the world. A number of construction methods are used to produce such fabrics, which generally relate to the type of end use requirements for the fabrics. Conventional backlit sign fabrics are typically constructed of 18 warp ends, 12 weft yarns, and 12 stitches or courses per inch of fabric. This results in one stitch for each weft yam.

More recently, lower priced production methods and materials have resulted in backlit sign fabrics with end uses that are less visually demanding. In fact, current backlit sign fabrics are formed with a stitch construction that allows excessive movement of the warp and weft yarns in the fabric. Such movement creates visible distortion in the fabric geometry as well as instability in the fabric. Instability in the substrate can lead to less sharply defined images in the backlit sign. As a further result, these backlit sign fabrics have major visual defects such as pick pairing and pick marks. Snags in the backlit sign fabrics and excessive movement of the warp and weft yarns in such fabrics are defects that are unacceptable in those applications where the backlit sign fabric is in close proximity to the viewer.

With the shortcomings of the current backlit sign fabrics, there exists a need for a fabric having exceptional fabric geometry to meet the visual standards for quality backlit sign fabric applications, strength as well as stability.

SUMMARY OF THE INVENTION

The present invention is directed to a warp knit, weft inserted fabric substrate having improved geometry for use as the strength component in a wide array of applications, the ability to withstand the rigors of further processing without distortion, and yet stable enough for use in subsequent high speed manufacturing processing. The fabric of the present invention is a stable knit fabric, which is constructed in such a manner that does not significantly increase fabric thickness. The overall geometry of the fabric reflects a "screen wire" type appearance that is aesthetically superior over prior art backlit sign fabrics. The warp knit, weft inserted fabric substrate is particularly suited for use on backlit signs, awnings, and other applications where reinforcement is desired. Such applications include, but are not limited to, tents, canopies, and banners.

The enhanced stability and geometry of the warp knit, weft inserted fabric substrate of the present invention is achieved by doubling the number of stitches or courses per inch without changing the number of weft yarns per inch of fabric. Doubling the number of stitches is achieved by shortening the stitch length and/or effecting at least two stitches for each weft yam. For example, in a typical fabric with an 18×12 construction, the number of stitches or course count doubles from 12 to 24. To avoid changing the number of weft yarns per inch, the weft yarns are inserted every other stitch. Even with these construction changes, the final fabric still maintains an 18×12 construction. The concept of doubling the stitches and inserting the weft yarns every other stitch may be used in other fabric constructions. For example, in a 9×9 fabric construction, the number of stitches per inch doubles from 9 to 18.

Due to the shortened stitch length, the weft or filling yarns are forced to remain in a restricted area of the fabric rather than move freely as is the case with the prior art fabric. As a result, the final fabric exhibits enhanced stability and exceptional visual geometry.

In producing the fabric of the present invention, a conventional warp knit, weft insertion knitting machine was used having only one knitting guide bar, another guide bar to lay in the warp strength element, and a weft insertion mechanism to lay in the weft or fill yarns. The knitting bar was operated with a movement of 1-0/1-2 and the lay in warp bar with a movement of 1—1/0—0. The final fabric construction was 18 warp ends per inch, 12 weft yarns or ends per inch, and 24 stitches or courses per inch.

In an embodiment of the present invention, a warp knit, weft inserted fabric substrate is produced for use as a strength component in backlit signs, awnings and in other applications where stability and uniform geometry is desired, comprising warp yarns extending in the warp direction of said fabric, weft yarns extending in the weft direction of said fabric, and stitching yarns forming stitches that hold said warp and weft yarns together, wherein at least two of said stitches are formed for every weft yarn.

In another embodiment of the present invention, the warp and weft yarns are made of polyester.

In yet another embodiment, a warp knit, weft inserted fabric substrate is produced having at least two stitches formed for every weft yarn, said fabric being constructed with a knitting bar movement of 1-0/1-2 and a lay in bar movement of 1—1/0—0.

In another embodiment, a warp knit, weft inserted fabric substrate is produced having at least two stitches formed for every weft yarn, said fabric being constructed with a knitting bar movement of 0-1/2-1 and a lay in bar movement of 1—1/1—1/0—0/0—0.

The preceding and further objects of the present invention will be appreciated by those of ordinary skill in the art from a reading of the figures and the detailed description of the preferred embodiments which follow, such description being merely illustrative of the present invention.

BRIEF DESCRIPTION OF THE DRAWINGS

FIG. 5 is a point diagram of the guide bars of the knitting machine to produce the fabric of the present invention.

FIG. 6 is a point diagram of the guide bars of the knitting machine to produce an alternative embodiment of the fabric of the present invention.

DETAILED DESCRIPTION OF THE PREFERRED EMBODIMENTS

Figure 1:
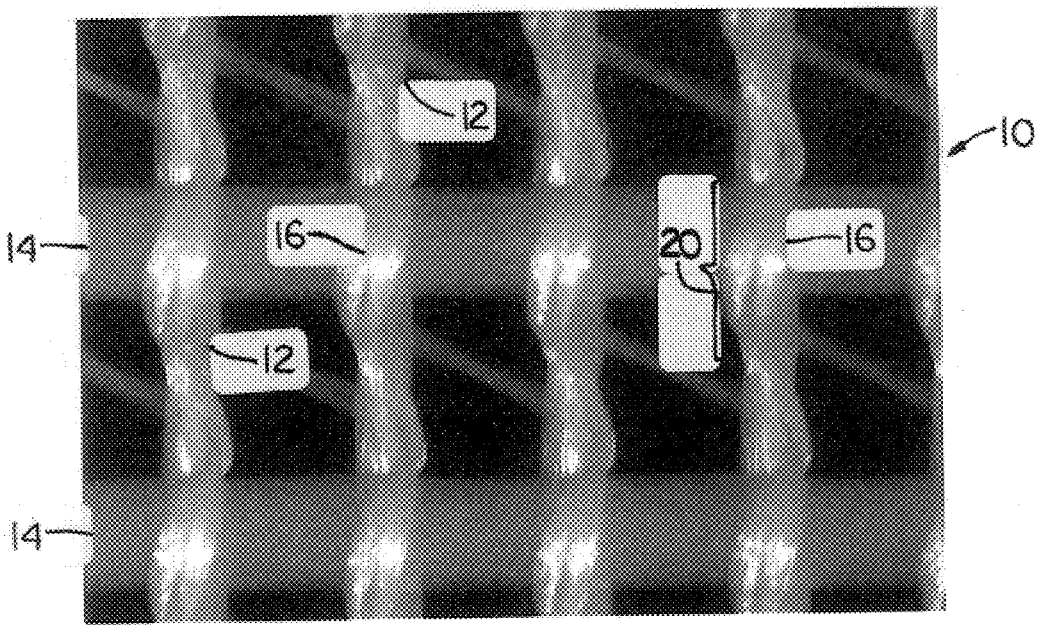
FIG. 1 is a photograph of the technical face of the warp knit, weft inserted fabric of the present invention. Magnification is at 25×.
Figure 2:
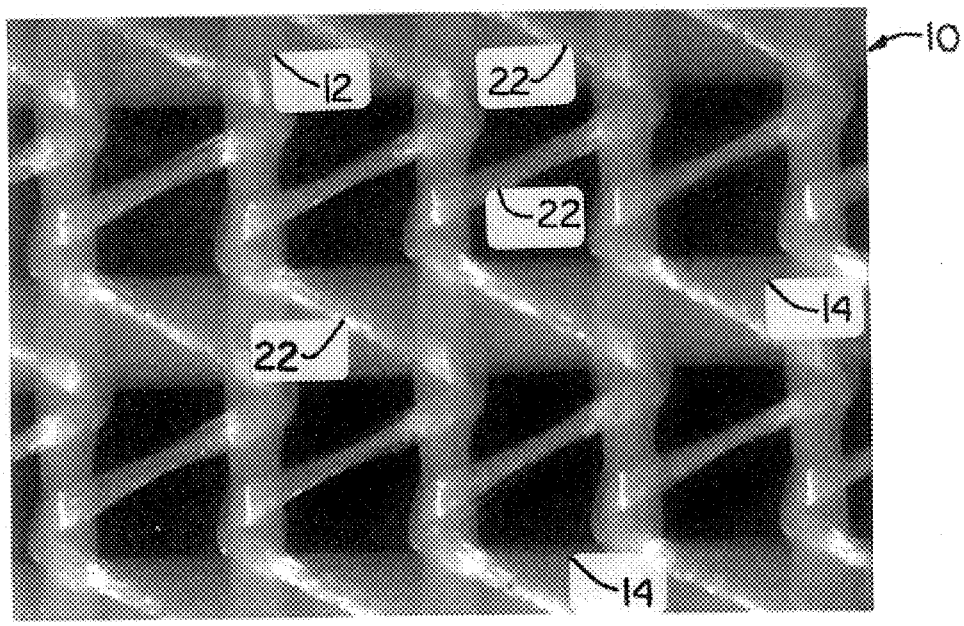
FIG. 2 is a photograph of the technical back of the warp knit, weft inserted fabric of the present invention. Magnification is at 25×.

According to the present invention, an improved warp knit, weft inserted fabric is provided, and is generally denoted by the numeral 10. Referring to FIGS. 1 and 2, the overall construction of fabric 10 is designed to provide greater stability and strength as well as improved geometry. While it is contemplated that fabric 10 of the present invention be used in backlit signs and awning applications, the fabric may be utilized in any other suitable applications where there is a need for reinforcement and geometric uniformity including, but not limited to, signs, banners, tents, canopies.

Fabric 10 was produced on a conventional warp knit, weft inserted knitting machine, a Mayer Textile type RS 3N-EMS, using only one guide (knitting) bar to form the stitch loops, a second guide bar to lay in the warp strength element, and a weft insertion mechanism to lay in the weft or fill yarns. For purposes of discussion only, a typical knitting cycle used to produce fabric 10 will be described with general references to a conventional knitting machine of the type used in the present invention It is believed that those of ordinary skill in the art of knit fabric construction shall be able to understand the basic mechanics of a conventional knitting machine without benefit of a drawing figure.

Referring to FIGS. 1–6,the impact of selection of stitch and fabric construction to enhance stability of the greige fabric should be apparent. Warp knit, weft inserted fabric 10 comprises warp yarns 12 extending in the warp-wise direction of fabric 10, which are made of polyester having a denier of between about 150 and about 2000. Warp yarns 12 are laid in using a guide bar with a preferred movement of 1—1/0—0. Weft or filling yarns 14 extend across the full width of fabric 10 in the weft-wise direction, and are positioned on top of the warp yarns 12 when viewing the technical face of fabric 10 in FIG. 1. Weft yarns 14 are constructed of polyester yarns having a denier between about 150 and about 1500.

Tricot stitching or tie yarns 16 positionally hold the warp yarns 12 and weft yarns 14 together in fabric 10. Individual stitching yarns 16 form stitch loops 18, collectively referred to as stitches 20, located on the technical face of fabric 10 and stitch underlaps 22, which are visible on the technical back of fabric 10. Stitch loops generally run along the warp direction of fabric 10. Referring to FIG. 1, it can be seen more clearly where the weft yarns 14 are inserted every other stitch 20.

The lateral movement of the guide bars determines the length of the stitch loops 18 and stitch underlaps 22. In fabric 10, each underlap 22 extends diagonally and connects one wale of warp yarns 12 to the adjacent wale of warp yarns 12. This underlapping occurs when the knitting guide bar shifts in front of the knitting needles during the knitting cycle. The stitching yarns 16 are made of polyester having a denier between about 20 and about 200. It is contemplated that other synthetic yarn types may be used to produce fabric 10.

Figure 3:
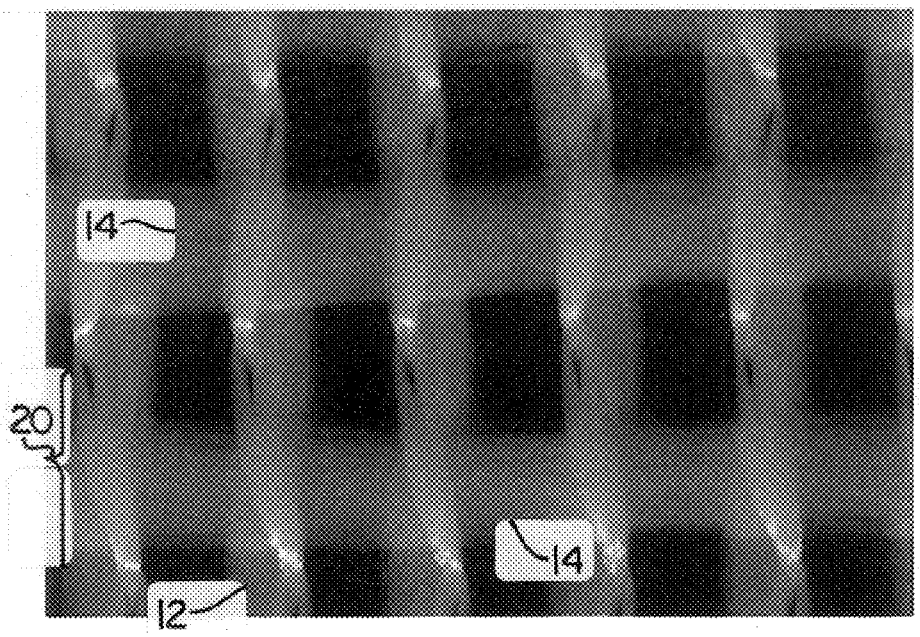
FIG. 3 is a photograph of the technical face of the prior art warp knit, weft inserted fabric. Magnification is at 25×.
Figure 4:
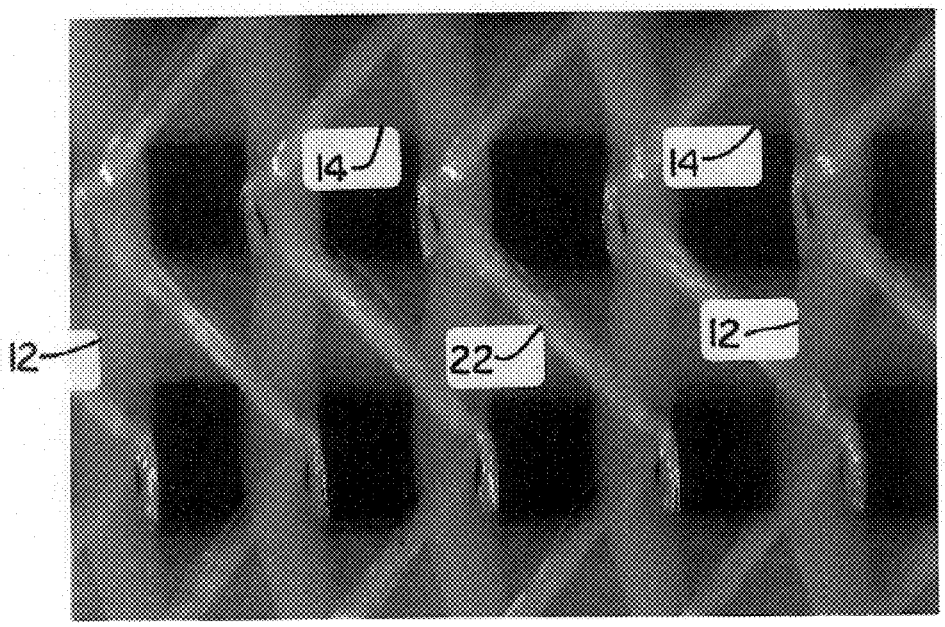
FIG. 4 is a photograph of the technical back of the prior art warp knit, weft inserted fabric. Magnification is at 25×.

Although the overall construction of fabric 10 produces a physical count of 18 warp yarns per inch, 12 weft ends per inch and 24 stitches or courses per inch, the stability and aesthetics of fabric 10 are greatly improved over prior art warp knit, weft inserted fabrics of the type shown in FIGS. 3 and 4 with several construction modifications. First, the length of stitch 20 is shortened, which is achieved by doubling of the number of stitches per inch in fabric 10. For example, in an 18×12 fabric construction, the number of stitches per inch of fabric increases from 12 stitches per inch to 24 stitches per inch. This doubling concept may be used in other fabric constructions. For example, in a 9×9 fabric, the number of stitches per inch doubles from the standard 9 to 18.

Doubling the number of stitches per inch forces the weft yarns 14 to remain in a more restricted area in fabric 10. Further, the number of underlaps 22 are also doubled, which function by holding the plurality of warp wale lines in place. As a result of these construction modifications, fabric 10 is much more stable and less susceptible to distortion of the type that occurs in the prior art warp knit, weft inserted fabric shown in FIGS. 3 and 4.

Referring to FIG. 2, the technical back view of fabric 10 of the present invention, the configuration of the fabric layers beginning with the outermost surface layer is as follows: 1) underlaps 22 are shown at a diagonal; 2) warp yarns 12 are positioned under the underlaps 22; 3) weft yarns 14 are positioned under the warp yarns 12 and the loops 18 of the stitching yarns 16 are positioned on the back side of the warp yarns 12.

Referring to the prior art fabric in FIG. 3, a stitch 20 that is longer than the one used in the present invention is shown. The longer stitch 20 allows greater movement of the warp 12 and weft 14 yarns, resulting in great distortion and visual defects like pick marks and pick paring in the fabric. Such defects worsen with further high speed processing, and often produce poor fabric geometry which is visible in products in close proximity to the viewer. Such distortion is visible in FIG. 4 where the warp 12 and weft 14 yarns exhibit severe bowing.

To avoid changing the overall construction of the fabric 10 with the doubling of the stitches, weft yarns 14 are inserted every other stitch 20. In other words, weft yarns 14 are omitted every other stitch 20. This construction feature is best illustrated in FIG. 2 where several alternating rows of underlaps 22 are seen without weft yarns 14 being inserted. This construction change facilitates the doubling stitch effect and enhances the overall stability of fabric 10 without dramatically increasing fabric thickness.

FIG. 5 is a point diagram showing the action of the guide bars of the knitting machine to produce a preferred embodiment of fabric 10. The pattern wheel for the front guide bar is set to knit a 1-0/1-2 tricot stitch that is closed. The pattern wheel for the back guide bar is set to knit 1—1/0—0 laid in warp yarns. In an alternative embodiment of the present invention shown in FIG. 6, the pattern wheel for the front guide bar is set to knit a 0-1/2-1 open tricot stitch, while the pattern wheel for the back guide bar is set to knit 1—1/1—1/0—0/0—0 laid in warp yarns.

The production of fabric 10 of the present invention, the details of which are described in Example 1, requires a conventional warp knit, weft inserted knitting machine. Fabric 10 is distinguishable over the prior art in its construction, wherein the number of stitches or courses are doubled, and every other weft yam is omitted in the weft carriage to produce a one in one out threading. Weft yarns 14 are inserted in front of the knitting needles for every up and down movement of the needle bar. Weft yarns 14 are brought forward on a series of hooks strung across the entire span of the width of the knitting machine. For every up and down motion of the needle bar, the weft yarns 14 come forward and are inserted in front of the needle at a specific time during the up and down cycle of the needle bar. Through the movement of warp 12 and stitching yarns 16 between the knitting needles and the shifting of these yarns behind the needles and back around, the stitch 20 that is formed on the needle connects and holds down the weft yarns 14 so that they are held in position by the underlap 22. Underlaps 22 are positioned diagonally going across the top of the weft yarns 14.

In the knitting machine of the type used in the present invention, a needle bar runs across the span of the frame work of the machine and moves in an up and down motion. Each of two guide bars holds or positions the warp 12 and stitching 16 yarns separately, and each are mounted into the machine. The guide bars swing through and back out between the needles. Thus, the guide bars are able to swing forward in front of the needles and swing backwards behind the needles. When the guide bars swing down through and between the needles, the bars swing with the guides or yarns positioned so that the guide bars take the yarns through and between the knitting needles in the configurations shown in FIGS. 5 and 6. The warp yarns 12 go down between the needles first followed by the stitching yarns 16. As the needle bar moves upward, the guide bars swing through and between the needles.

The first yam carried through between the needles is the warp yarn 12. After the warp yarns 12 pass through the needles, the next guide bar holding the stitching yarns 16 swings through the needles. Once all the yarns have passed and cleared the needles, then the guide bars shift left or right depending on the stitch notation. Then, the guide bars swing back forward through the needles and then shift in front of the needles, carrying the yarns from one side of the needle around to the other side of the needle. Thus, stitch loops 18 and underlaps 22 are created. When the guide bars come back through and the needles begin to descend, the yarns slide up into the back of the hook of the needles where the yarns are caught by the hooks and then pulled down through the previous loop. Within each knitting cycle, the warp yarns 12 and stitching yarns 16 are constructed in the desired configurations shown in FIGS. 5 and 6. Once fabric 10 is knitted, it is then subjected to a high speed finishing process where it is heat set with a binder and an optical brightener and then trimmed.

Referring to FIG. 1, the technical face of fabric 10, the shorter length of the stitches 20 is a function of the rate or speed at which the stitches are removed from the knitting needles. This is controlled by a series of rollers on the knitting machine. Once fabric 10 is made, it is removed from the knitting machine and laced around a series of rollers in an "S" configuration. To control and/or adjust the number of stitches per one inch of fabric, one can either increase or decrease the speed of these rollers, which pull fabric 10 off of the knitting needles either at a slow or fast rate. To do this, first determine the number of stitches or courses per inch that is desired for the fabric being constructed, for example, 9, 18, 24 or any number. The desired number of stitches per inch equates to a specific number of inches of fabric per rack. It is known that one rack=480 revolutions of the knitting machine. Determine the number of stitches per inch that is desired and then divide this number into 480. The resulting value represents the number of inches of fabric that will be produced from the knitting machine based on a specific number of stitches per inch. Next, determine the gear ratio from the knitting machine chart typically provided by the machine manufacturer, which corresponds to the inches of fabric or yam per rack for the desired number of stitches per inch. Then set the gear ratios on the machine accordingly.

In placing the yarns in the proper sequence for knitting, as the needles begin to rise up, the weft yarns 14 are brought forward in front of the needle. Then the warp yarns 12 and knitting stitch yarns 16 are carried through between the needles. The warp yarns 12 go first against the weft yarns 14 and are carried through between the needles with the weft yarns already being strung across. The warp yarns will, therefore, lay on top of the weft yarns 14 with both yarns being secured by the stitching yarns 16. Movement of the guide bar and the knitting formation of the stitching or tie yam 16 creates the loop behind on the opposite side of the fabric 10. The lateral movement of the guide bars dictates the length of the underlap 22 and overlap 18. In fabric 10, one underlap connects one warp yam 12 across to the next warp yam 12, which occurs when the guide bar shifts in front of the needles. The loop formation or stitch 20 occurs on the backside of fabric 10 when the guide bar shifts and goes behind the needles.

Doubling the number of stitches 20 in fabric 10 and alternating the weft yarns 14 every other stitch produces a physical count of 18 warp yarns per inch, 12 weft yarns per inch and 24 courses per inch, which visually meets the industry standard fabric construction. The warp ends range from approximately 5 to about 20 per inch and the weft yarns range from about 10 to about 20 per inch. The number of stitches ranges from about 10 to about 48 per inch. It is contemplated that the number of stitches 20 may vary for every weft yarn 14 that is inserted, for example, three, four, or five stitches per inch of fabric, depending on the desired fabric construction.

Fabric 10 was produced in accordance with the process parameters shown below in Example 1. Comparative Example 2 describes the process by which prior art warp knit, weft inserted fabrics are currently made.

EXAMPLE 1
PROCESS FOR PRODUCING WARP KNIT, WEFT INSERTED KNIT (WIWK) FABRIC OF THE PRESENT INVENTION

| | |
|---|---|
| TYPE FABRIC: | WIWK Polyester Base |
| CATEGORY: | H4 |
| CONSTRUCTION: | 18 × 12 (Round Stitch) |
| COURSES/INCH | 24 (12 Visual) |
| SELVAGE: | Feathered |
| FABRIC INCHES/RACK: | 20.00 |

YARN DESCRIPTION

| | |
|---|---|
| Bar 1 | 70/30 denier polyester |
| Bar 2 | 840/140 denier polyester |
| Weft Inserted | 1000/140 denier polyester |

| | |
|---|---|
| M/C TYPE: | MAYER |
| #GUIDE BARS: | 2 (1 + ST) |
| GAUGE: | 18 Needles/inch (Npi) |
| COURSES/INCH: | 24 (12 Visual) |

| | THREADING: | STITCH NOTATION: |
|---|---|---|
| Bar 1 | Full @ 18/inch | 1-0/1-2// |
| Bar 2 | Full @ 18/inch | 1-1/0-0// |
| BAR 3: | | |
| WEFT: | 1 every other course (= half threading of the weft carriage or 1 in 1 out threading) | |

COMPARATIVE EXAMPLE 2
PROCESS FOR PRODUCING PRIOR ART WARP KNIT, WEFT INSERTED (WIWK) FABRIC

| | |
|---|---|
| TYPE FABRIC: | WIWK Polyester Base |
| CATEGORY: | C3 |

-continued

COMPARATIVE EXAMPLE 2
PROCESS FOR PRODUCING PRIOR ART WARP KNIT, WEFT INSERTED (WIWK) FABRIC

| | |
|---|---|
| CONSTRUCTION: | 18 × 12 |
| COURSES/INCH | 11.5 |
| SELVAGE: | Feathered |
| FABRIC INCHES/RACK: | 41.72 |

YARN DESCRIPTION

| | |
|---|---|
| Bar 1 | 70/48 denier polyester |
| Bar 2 | 840/140 denier polyester |
| Weft Inserted | 1000/140 denier polyester |

| | |
|---|---|
| M/C TYPE: | MAYER RS3-EMS |
| #GUIDE BARS: | 2 (1 + ST) |
| GAUGE: | 18 Needles/inch (npi) |
| COURSES/INCH: | 11.5 |

| | THREADING: | STITCH NOTATION: |
|---|---|---|
| Bar 1 | Full @ 18/inch | 1-0/1-2// |
| Bar 2 | Full @ 18/inch | 1-1/0-0// |
| BAR 3: | | |
| WEFT: | Full @ 1 every course | |

Comparison testing was conducted to evaluate the strength of fabric 10 versus prior art fabric. Four different rolls of fabric 10 were tested, while one roll of prior art fabric was tested. The following physical properties of fabric 10 and the prior art fabric were measured: width of fabric in inches; the number of ends per inch in the warp direction; picks ( the number of weft yarns per inch), weight of the fabric; gauge or thickness (in inches) of the fabric defined by the body (the fabric anywhere across the width except for the selvage) and the selvage (fabric edge); % shrinkage of the fabric in the warp and fill directions; strips (fabric is cut into strips and tested for tensile strength on an Instron machine); % elongation (the amount of stretch in the fabric before it tears); grabs (certified measurement of the fabric tensile strength); and % crimp.

The results, shown below in EXAMPLES 3 and 4, demonstrate that the strength of fabric 10 is significantly stronger than the prior art fabric. This is evident from the tensile strength values obtained for each fabric as noted under the "strips" and "grabs" columns. On the average, an additional 43 pounds of force was needed to tear the fabric of the present invention in the warp and weft direction as compared to the prior art fabric. Such strength allows fabric 10 to have greater stability and geometric precision than the prior art fabrics.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

EXAMPLE 3
Greige Fabric of the Present Invention

| | | | | | Thickness (inches) | | % Shrinkage | |
|---|---|---|---|---|---|---|---|---|
| Style | Width | Ends | Picks | Weight | Body | Selvage | Warp | Fill |
| A | 82.34 | 16.00 | 12.00 | 4.46 | 0.012 | 0.028 | 5.0 | 3.0 |
| B | 82.75 | 18.30 | 12.00 | 4.44 | 0.018 | 0.028 | 4.6 | 3.5 |
| C | 82.86 | 18.25 | 12.00 | 4.39 | 0.017 | 0.025 | 5.0 | 4.0 |
| D | 82.44 | 18.20 | 12.00 | 4.39 | 0.017 | 0.027 | 5.0 | 3.0 |

| | Strips | | % Elongation | | Grabs | | % Elongation | | % Crimp | |
|---|---|---|---|---|---|---|---|---|---|---|
| Style | Warp | Fill | Warp | Fill | Warp | Fill | Warp | Fill | Warp | Fill |
| A | 243 | 190 | 33 | 32 | 295 | 192 | 31 | 33 | 1.770 | 0.000 |
| B | 279 | 199 | 33 | 34 | 282 | 202 | 32 | 33 | | |
| C | 257 | 189 | 33 | 34 | 285 | 202 | 32 | 33 | | |
| D | 255 | 186 | 33 | 33 | 264 | 177 | 33 | 30 | | |

EXAMPLE 4
Greige Prior Art Fabric

| | | | | | Thickness (inches) | | % Shrinkage | |
|---|---|---|---|---|---|---|---|---|
| Style | Width | Ends | Picks | Weight | Body | Selvage | Warp | Fill |
| E | 78.65 | 18.05 | 12.06 | 4.32 | 0.013 | 0.020 | 3.2 | 2.7 |

| | Strips | | % Elongation | | Grabs | | % Elongation | |
|---|---|---|---|---|---|---|---|---|
| Style | Warp | Fill | Warp | Fill | Warp | Fill | Warp | Fill |
| E | 222 | 181 | 38 | 36 | 249 | 157 | 38 | 36 |

We claim:

1. A warp knit, weft inserted fabric substrate for use as a strength component in backlit signs, awnings and in other applications where stability and uniform geometry is desired, comprising warp yarns extending in the warp direction of said fabric, weft yarns extending in the weft direction of said fabric, and stitching yarns forming stitches that hold said warp and weft yarns together, wherein at least two of said stitches are formed for every weft yarn, the warp yarns range from approximately 5 to about 20 per inch, the weft yarns range from about 10 to about 20 per inch, and the number of stitches ranges from about 10 to about 48 per inch.

2. The warp knit, weft inserted fabric substrate according to claim 1, wherein said warp yarns and weft yarns are polyester.

3. The warp knit, weft inserted fabric substrate according to claim 1, wherein said weft count in ends per inch of fabric is one-half the stitch count.

4. The warp knit, weft inserted fabric substrate according to claim 1, wherein said stitching yarns are made of a denier polyester between approximately 20 and about 200.

5. The warp knit, weft inserted fabric substrate according to claim 2, wherein said warp yarns are made of a denier polyester between approximately 150 and about 2000.

6. The warp knit, weft inserted fabric according to claim 2, wherein said weft yarns are made of a denier polyester between approximately 150 and about 1500.

7. The warp knit, weft inserted fabric according to claim 1, wherein the stitch notation for said stitching yarns is 1-0/1-2.

8. The warp knit, weft inserted fabric substrate according to claim 1, wherein the stitch notation for the stitching yarns is 0-1/2-1.

9. The warp knit, weft inserted fabric substrate according to claim 1, wherein the stitch notation for the warp yarns is 1—1/0—0.

10. The warp knit, weft inserted fabric substrate according to claim 1, wherein the stitch notation of the warp yarns is 1—1/1—1/0—0/0—0.

11. The warp knit, weft inserted fabric substrate according to claim 1, wherein said warp ends range from approximately 5 to about 20 per inch, the weft yarns range from about 10 to about 20 per inch, and the number of stitches ranges from about 10 to about 48 per inch.

12. A warp knit, weft inserted fabric substrate comprising warp yarns extending in the warp direction of said fabric, weft yarns extending in the weft direction of said fabric, and stitching yarns forming stitches that hold said warp and weft yarns together and having at least two stitches formed for every weft yarn, wherein said warp yarns range from approximately 5 to about 20 per inch, the weft yarns range from about 10 to about 20 per inch and the number of stitches ranges from about 10 to about 48 per inch, said fabric being constructed with a knitting bar movement of 1-0/1-2 and a lay in bar movement of 1—1/0—0.

13. The warp knit, weft inserted fabric substrate according to claim 12, wherein said warp yarns and weft yarns are polyester.

14. The warp knit, weft inserted fabric substrate according to claim 12, wherein the weft yarn count in ends per inch of fabric is one-half the stitch count.

15. The warp knit, weft inserted fabric substrate according to claim 12, wherein said stitches are made of a denier polyester between approximately 20 and about 200.

16. The warp knit, weft inserted fabric substrate according to claim 12, wherein said warp yarns are made of a denier polyester between approximately 150 and about 2000.

17. The warp knit, weft inserted fabric substrate according to claim 12, wherein said weft yarns are made of a denier polyester between approximately 150 and about 1500.

18. A warp knit, weft inserted fabric substrate comprising warp yarns extending in the warp direction of said fabric, weft yarns extending in the weft direction of said fabric, and stitching yarns forming stitches that hold said warp and weft yarns together and having at least two stitches formed for every weft yam, wherein the warp yarns range from approximately 5 to about 20 per inch, the weft yarns range from about 10 to about 20 per inch, and the number of stitches ranges from about 10 to about 48 per inch, said fabric being constructed with a knitting bar movement of 0-1/2-1 and a lay in bar movement of 1—1/1—1/0—0/0—0.

* * * * *